United States Patent [19]

Sundman

[11] 4,115,186

[45] Sep. 19, 1978

[54] PROCESS FOR BLEACHING CELLULOSE PULP WITH MOLECULAR OXYGEN

[75] Inventor: Frey Viking Sundman, Karhula, Finland

[73] Assignee: A. Ahlstrom Osakeyhtio, Finland

[21] Appl. No.: 468,185

[22] Filed: May 8, 1974

[30] Foreign Application Priority Data

May 30, 1973 [FI] Finland ..... 1766/73

[51] Int. Cl.[2] ..... D21C 9/10

[52] U.S. Cl. ..... 162/65; 162/38

[58] Field of Search ..... 162/65, 38, 237, 239, 162/250; 68/5 D, 181 R

[56] References Cited

U.S. PATENT DOCUMENTS 3,759,783 9/1973 Samuelson et al. ..... 162/65 X 3,832,276 8/1974 Roymoulik et al. ..... 162/65

*Primary Examiner*—S. Leon Bashore

*Assistant Examiner*—Steve Alvo

[57] ABSTRACT

A process for bleaching cellulose pulp with molecular oxygen under alkaline conditions and at an elevated temperature in a bleaching zone is disclosed in which oxygen gas is dispersed into an alkaline bleaching solution under an increased pressure, the oxygen-containing, alkaline bleaching solution is heated to at least the elevated bleaching temperature, the pressure of the hot, oxygen-containing, alkaline bleaching solution is lowered to the pressure prevailing in the bleaching zone, and the hot, oxygen-containing, alkaline bleaching solution is brought, in the bleaching zone, into contact with the cellulose pulp to bleach the latter with the oxygen gas released from the bleaching solution.

4 Claims, 1 Drawing Figure

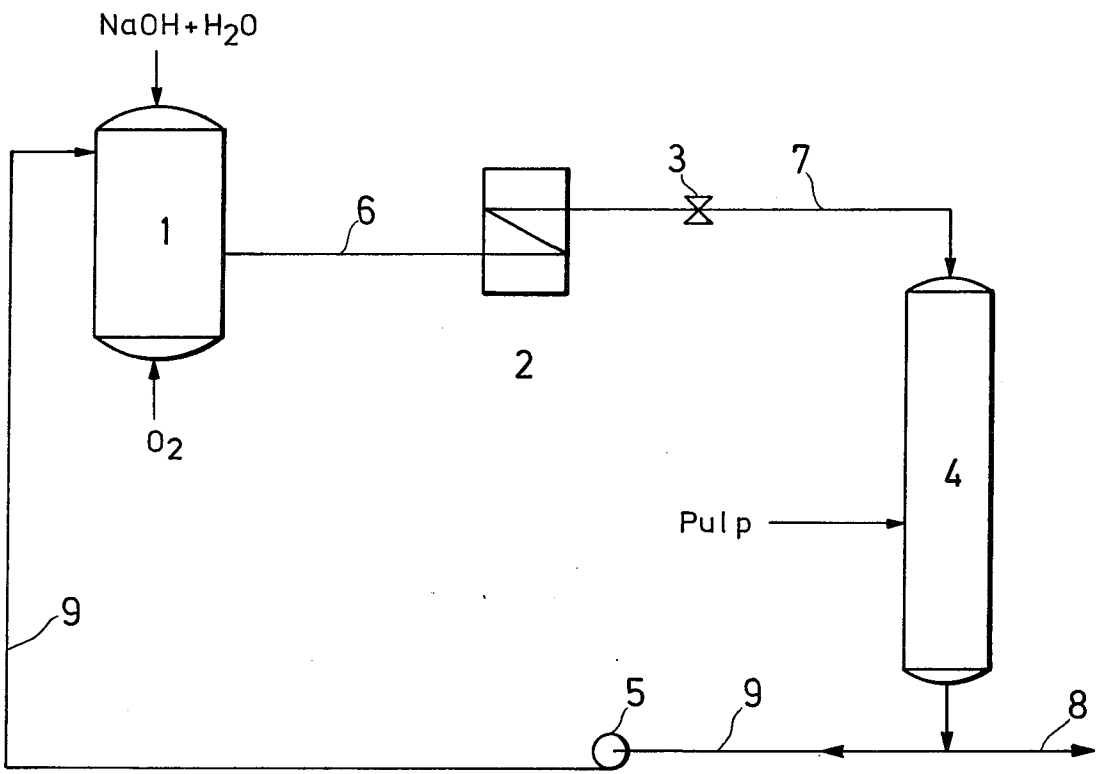
NaOH+H2O
1
O2
6
2
3
7
4
Pulp
5
9
8
9

PROCESS FOR BLEACHING CELLULOSE PULP WITH MOLECULAR OXYGEN

BACKGROUND OF THE INVENTION

The present invention relates to a process and device for bleaching cellulose pulp with molecular oxygen under alkaline conditions and at an elevated temperature.

The use of oxygen in the bleaching of cellulose has been an object of increasing interest in recent years. Oxygen-alkali bleaching has considerable advantages when compared with the previous processes using chlorine chemicals.

According to one known process, the oxygen-alkali treatment of pulp is carried out so that alkali-treated pulp with a fiber concentration of some 25% is fed into a tank which contains oxygen gas.

According to another process, oxygen gas is fed into a tank which contains cellulose fibers in an alkali solution.

It has also been suggested that the oxygen gas treatment be carried out by displacing liquid from alkali-treated pulp by means of pressurized oxygen gas.

All the above, previously known processes require large reaction tanks. The velocity of the bleaching reaction is dependent on the temperature. For this reason it is desirable to maintain a relatively high temperature in the tank. The dissolving of oxygen in the alkali solution decreases when the temperature raises, whereby the treatment period is lengthened. The concentration of oxygen increases along with pressure, so that when a short treatment period is the object, a high pressure must be used, which results in high equipment costs.

The object of the present invention is to provide a process and device for bleaching cellulose pulp with molecular oxygen, without the above disadvantages.

SUMMARY OF THE INVENTION

The process is characterized in that oxygen is dissolved in the alkali solution before it is fed into the tank where the delignification of cellulose takes place. The absorption of oxygen into the alkali solution takes place under a great pressure and at a low temperature, which is advantageous in terms of oxygen absorption. Thereafter, the oxygen-saturated alkali solution is heated to a temperature advantageous for the bleaching reaction, and the pressure is lowered. Since the pressure prevailing in the bleaching tank is low, the construction is inexpensive. The oxygen-alkali treatment takes place preferably by displacing the liquid present in the pulp. Owing to this and the high oxygen concentration, the necessary treatment period is short and the tank volume small.

The thickness of the pulp to be treated is preferably about 8 to 18% and it is fed into a bleaching tank in which a pressure of about 0 to 8 atm. and a temperature of 80° to 130° C. prevail. In the absorption tank, oxygen is dispersed into a water solution of an alkali, such as sodium hydroxide, sodium carbonate, calcium hydroxide, or ammonium hydroxide, under a pressure of about 0 to 50 atm. and at a temperature of about 0° to 100° C. Before this oxygen-rich liquid is fed into the bleaching tank, its pressure is lowered to substantially the same pressure as prevails in the bleaching reactor and its temperature is simultaneously raised.

DESCRIPTION OF THE PREFERRED EMBODIMENT

The invention is described below in more detail with reference to the enclosed drawing, which shows schematically a side view of a device meant for carrying out the process according to the invention.

The absorption tank 1 operates at a temperature of 20 C. and under a pressure of 30 atm., and a water solution of sodium hydroxide and oxygen gas are fed into it. The oxygen-saturated protein solution is then fed along the pipe 6 into the heating device 2, where the bleaching solution is heated from 20° C. to about 110° C. or slightly above. Then the hot bleaching solution is led through the decompression valve 3 in the pipe 7 into the bleaching tank 4, where a temperature of about 110° C. and a pressure of 3 atm. are maintained. When the pressure has lowered, the hot bleaching solution yields the oxygen it has absorbed. This oxygen bleaches the cellulose pulp, the fiber concentration of which is about 13%. The bleached pulp and the bleaching liquid are removed from the bleaching tank 4 through the outlet pipe 8, and part of the bleaching solution is recirculated to the absorption tank 1 through the pipe 9 and the pump 5.

What is claimed is:

1. A process for bleaching cellulose pulp with molecular oxygen in an alkaline medium which comprises the steps of:

(1) dispersing oxygen gas into an alkaline solution under a pressure of up to 50 atmospheres and at a temperature between 0° and 100° C. whereby an oxygen-rich alkali solution is obtained;

(2) heating the oxygen-rich alkaline solution at a temperature between 80° and 130° C., the temperature being so selected within said range, that it is higher than the temperature in step (1);

(3) lowering the pressure of the hot, oxygen-containing, alkaline bleaching solution to a pressure between 0 and 8 atmospheres, said pressure being so selected within said range that it is lower than the pressure in step (1) so as to release oxygen from said alkaline solution;

(4) introducing the hot, oxygen-containing, alkaline solution into a bleaching reactor into contact with the cellulose pulp at a temperature of 80°–130° C. and at a pressure of 0–8 atmospheres to bleach the pulp with the oxygen gas being released from said solution.

2. The process according to claim 1, wherein oxygen is dispersed into the alkaline bleaching solution at a pressure of about 30 atmospheres and at a temperature of about 20° C..

3. A process according to claim 1, wherein the bleaching in step (4) is carried out at a pressure of about 3 atmospheres and at a temperature of about 110° C..

4. A process according to claim 1, wherein the bleaching solution used is an aqueous solution of a compound which is sodium hydroxide, sodium carbonate, calcium hydroxide, or ammonium hydroxide.

* * * * *